United States Patent [19]

Milu

[11] Patent Number: 4,569,314

[45] Date of Patent: Feb. 11, 1986

[54] TWO-STROKE AXIAL PISTONS ENGINES

[75] Inventor: Petre Milu, Bucharest, Romania

[73] Assignee: Institutul National de Motoare Termice, Bucharest, Romania

[21] Appl. No.: 396,913

[22] PCT Filed: Oct. 31, 1981

[86] PCT No.: PCT/RO81/00007

§ 371 Date: Jul. 1, 1982

§ 102(e) Date: Jul. 1, 1982

[87] PCT Pub. No.: WO82/01570

PCT Pub. Date: May 13, 1982

[30] Foreign Application Priority Data

Nov. 1, 1980 [RO] Romania ..... 102487

[51] Int. Cl.[4] ..... F02B 25/00

[52] U.S. Cl. ..... 123/58 R; 123/65 VC; 123/51 B

[58] Field of Search ..... 123/65 VC, 58 B, 58 R, 123/58 BA, 58 BB, 58 BC, 51 R, 51 B, 51 BC

[56] References Cited

U.S. PATENT DOCUMENTS

| | | | |
|---|---|---|---|
| 1,168,877 | 1/1916 | Froehlich | 123/58 BC |
| 1,204,892 | 11/1916 | Macomber | 123/58 BA |
| 1,250,709 | 12/1917 | Tanner | 123/65 VC |
| 1,492,215 | 4/1924 | Nedoma | 123/58 BA |
| 1,656,884 | 1/1928 | Davol | 123/51 B |
| 2,565,272 | 8/1951 | Sherman | 123/58 BC |

FOREIGN PATENT DOCUMENTS

| | | | |
|---|---|---|---|
| 4313 | of 1910 | United Kingdom | 123/58 BC |
| 160479 | 3/1921 | United Kingdom | 123/58 BC |

*Primary Examiner*—Craig R. Feinberg
*Assistant Examiner*—David A. Okonsky
*Attorney, Agent, or Firm*—Karl F. Ross; Herbert Dubno

[57] ABSTRACT

A two-stroke axial engine in which the inlet of fresh mixture is effected directly in a scavenging chamber through an aperture actuated by the primary shaft, the fresh mixture being thereafter exhausted under the control of the piston from the scavenging chamber through scavenging apertures into a combustion chamber, and between the scavenging chamber and the crankcase there being mounted a separator, and a fork mounted on an oscillator and slidable on a guiding rail pivotable on two bearings.

1 Claim, 4 Drawing Figures

TWO-STROKE AXIAL PISTONS ENGINES

FIELD OF THE INVENTION

The invention refers to a two-stroke, axial pistons engine, with pressurized scavenging chamber, which may be used to drive both transport means and power plants.

BACKGROUND OF THE INVENTION

Multicylinder internal combustion engines with axial pistons are known, in which the pistons are placed two by two, opposed, in the same cylinder, the guiding rail which prevents the oscillator rotation being fixed, the gaseous exchange being achieved through scavenging apertures, which make a direct connection between the cylinder and the precompression space which may be achieved by the compressor near the engine. The shortcoming of these engines is that they do not solve the problem of a total operational freedom of the connecting rod and of the oscillator guide. At the same time, they do not provide an adequate gaseous exchange which would result in a high volumetric efficiency.

SUMMARY OF THE INVENTION

According to the present invention, the two-stroke axial engine does not have any of the above-mentioned shortcomings, because in order to ensure an optimization of the gaseous exchange, which should account for a high volumetric efficiency, and a free movement of the connecting rod-oscillator system, the intake of the fresh mixture is effected directly in a scavenging chamber through an inlet aperture placed in the lower part of the cylinder and actuated by the primary shaft, which, with this end in view, has a longitudinal groove, the fresh mixture actuated by the piston being then forced from the scavenging chamber by means of scavenging apertures into a combustion chamber. Between the scavenging chamber and the crankcase interior there is mounted a separator formed by a case fixed on the cylinder block, a first spherical bushing installed between the case and a mobile connection, a second spherical bushing mounted between the mobile connection and the connecting rod, between the first spherical bushing and the mobile connection, and between the second spherical bushing and the case being mounted on a ring-shaped gasket. In order to prevent oscillator lock, a fork is mounted in the body of the oscillator, having relative rotating possibilities, and the guiding rail on which the fork slides is assembled in the cylinder block in two bearings, which allows it to rotate.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
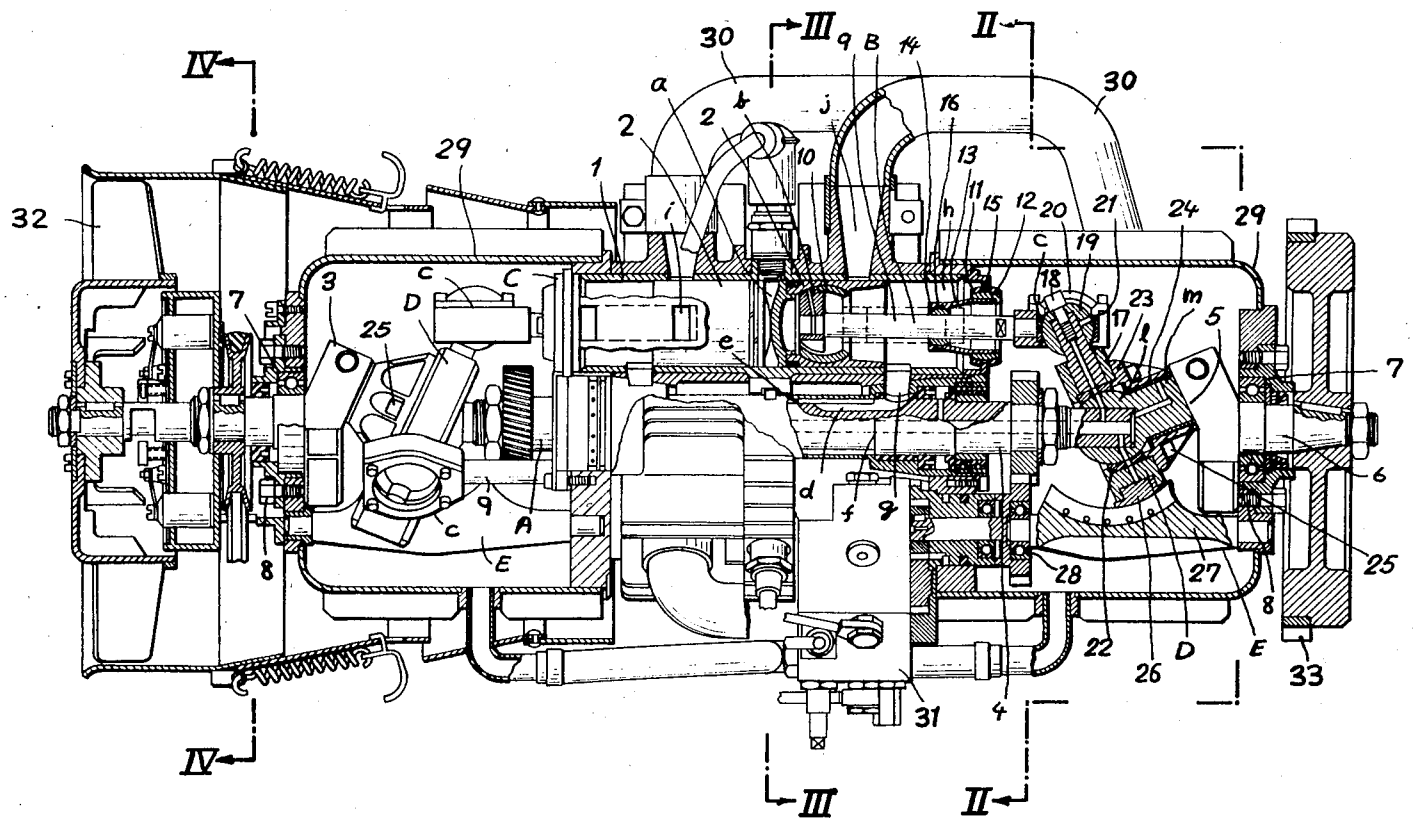
FIG. 1 is an axial sectional view of the engine according to the invention.
Figure 2:
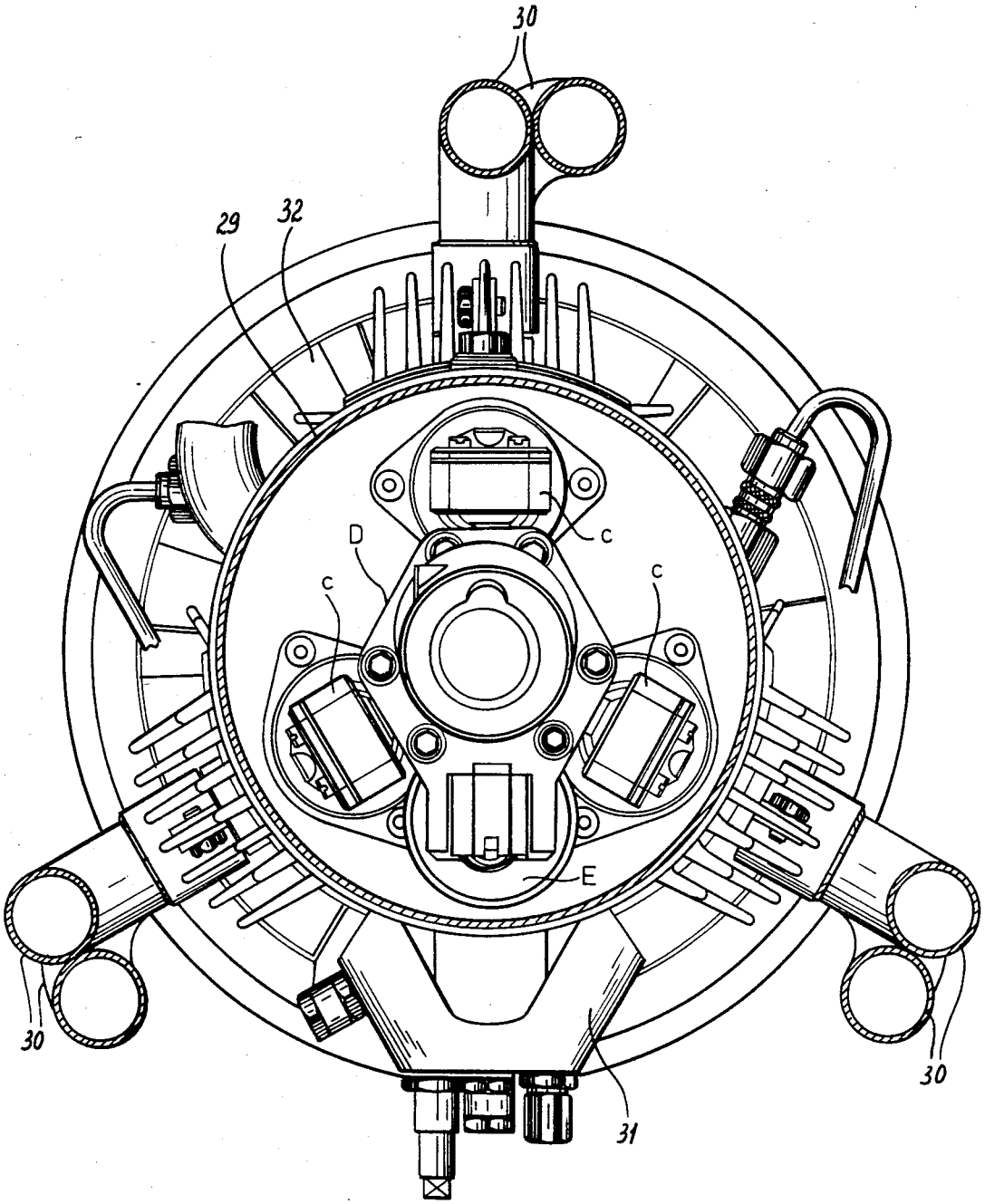
FIG. 2 is a sectional view taken along line II—II of FIG. 1.
Figure 4:
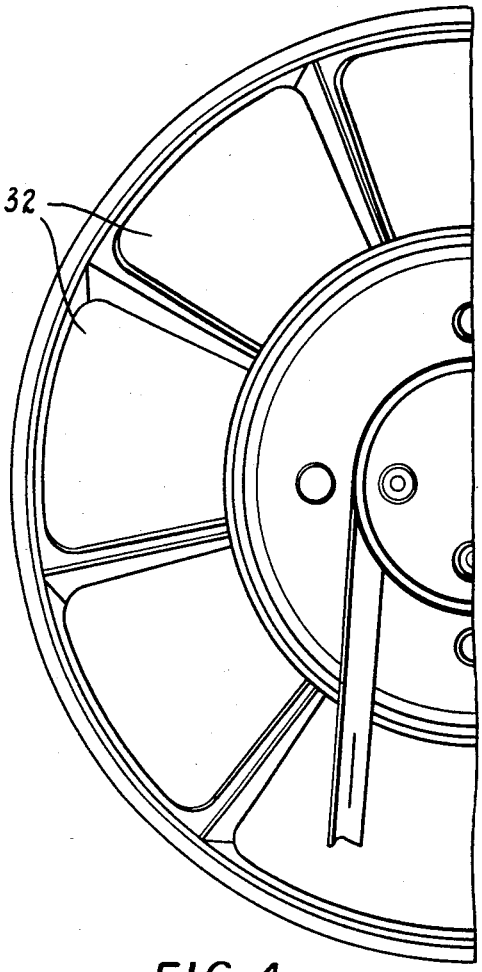
FIG. 4 is a half sectional view taken along line IV—IV of FIG. 1, the other half being mirror-identical thereto.
Figure 3:
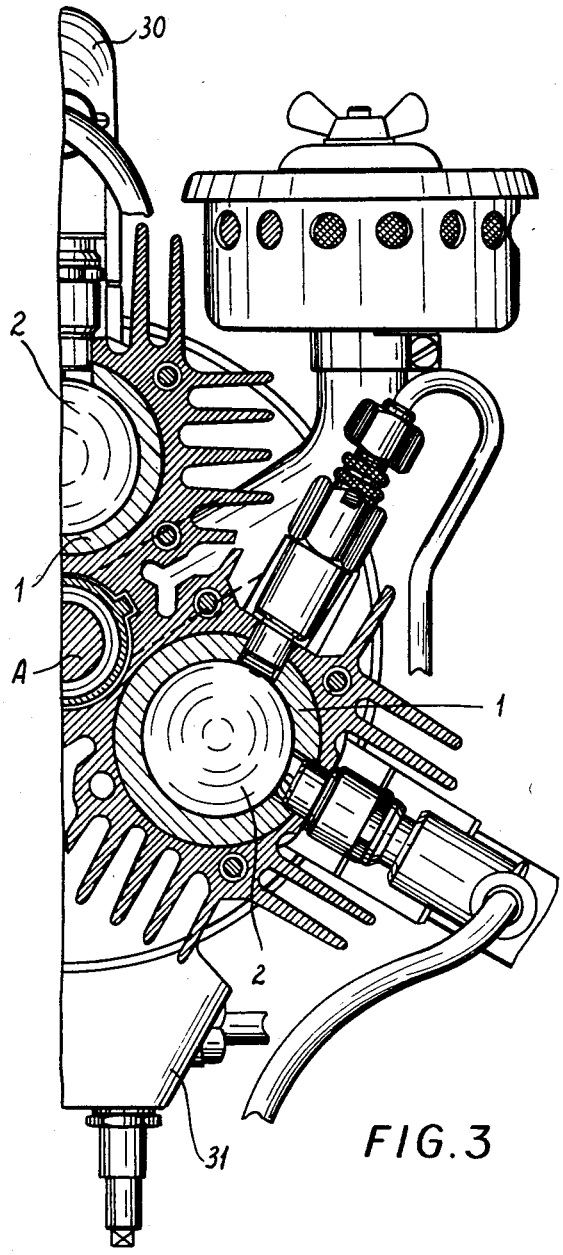
FIG. 3 is a half sectional view taken along line III—III of FIG. 1, the other half being mirror-identical thereto.

The two-stroke axial engine of the present invention is made up, essentially, of a primary shaft A carrying a cooling fan 32 at one end and an output gear 33 at the other end and mounted parallel to the engine cylinders 1, within each of which are two working pistons 2, so that they form between them a combustion chamber a, the pistons being connected by means of a spherical articulation b with the connecting rods B, which, oscillating during the operation, acts to oscillate a separator C which divides the cylinder from the crankcase 29 in an already known manner.

At the other end, the connecting rods B are also connected by means of a spherical articulation c to an oscillator D.

The axial engine also includes a subassembly E meant to guide oscillator movement. The primary shaft A, whose role is to provide the control of the gaseous exchange and to transmit the torque outwards, is made up of four sections 3, 4, 5 and 6 which are assembled and journaled by means of end bearings 7 and tightening screws 8. Two longitudinal grooves d are provided in the central section 4 of the primary shaft on the same generator, in order to provide the intake of fresh air or the combustion mixture from the intake manifold, which is already known and which is not represented in the drawing.

The air or the combustion mixture from the intake manifold passes through an aperture in the cylinder block 31, already known in the art, in order to reach an annular space e, created by a diameter reduction f of the section 4 of the primary shaft A. From the cylindrical space e the air or the combustion mixture passes into the scavenging chambers h when the grooves d arrive in front of the intake apertures g. Thus, the primary shaft A controls air or combustion mixture intake in the scavenging chamber h, where the whole quantity of air or mixture is retained, which results in a higher volumetric efficiency. From the scavenging chamber h the fresh charge passes into the combustion chamber a of the cylinder 1 through the scavenging apertures i controlled by the piston 2. Under the action of the flowing fresh charge, the cylinder is scavenged, the combustion gases being exhausted through the exhaust apertures j and through exhaust pipes 30.

The connecting rod B is made up of a cylindrical rod 9, a spherical element 10, which co-operates in the spherical articulation b connected with the piston 2, and in the spherical articulation c connected with the oscillator D. During the operation the connecting rod B has a spacial movement, generating a conical area with an elliptical section, the spacial movement of the connecting rod B being determined by the guide E and by the gaps in the spherical bearings 22, through which the oscillator D is mounted on the primary shaft A, as well as by the inherent mounting deviations of the sections 3, 4, 5 and 6 of the primary shaft A.

The separator C offers a pendulary and a translation mobility to the connecting rod B and it is made up of a case 11, mounted on the cylinder block, a first spherical bushing 12 mounted between the case 11 and a mobile connection 13, as well as of a second spherical bushing 14 mounted between the mobile connection 13 and the connecting rod 9.

The ring-shaped gaskets 16 and 15 are mounted respectively between the spherical bushing 14 and the mobile connection 13, and between the spherical bushing 12 and the case 11. In order to ensure a free translation movement between the connecting rod 9 and the cylindrical inner surface of the spherical bushing 14, an antifriction material, for example a bronze alloy, is deposited on the cylindrical inner surface of the spherical bushing 14.

In order to keep the scavenging chamber h gastight it is recommended that both the connecting rod 9 and the cylindrical inner surface of the spherical bushing 14 should be closely fitted. By means of its biarticulated construction, the separator C ensures the isolation of the space corresponding to the scavenging chamber h and the interior of the crankcase 29. The separation of the scavenging chamber h from the space of the crankcase 29 facilitates an increase of the filling efficiency, as well as a better scavenging of the interior of the cylinder 1, due to the fact that the fresh mixture comes, under pressure, from both directions, into the scavenging chamber h, through the scavenging apertures i.

The oscillator D has a body made up of two flanges 17, with bolts 18, placed radially towards the body, and which link the body of the oscillator D to the spherical elements 19, which, together with the spherical cavity cage 20 and the liner 21 make up the spherical articulations c, as well as a spherical bearing liner 22, crankpin bearing case 23, a crankpin bearing liner 24, and tightening screws 25.

The spherical bearing liner 22, made up of an antifriction material, facilitates the free oscillation of the oscillator body D on a spherical end l of the section 5 of the primary shaft A.

The crankpin bearing case 23 is mounted, by means of the tightening screws 25, on the body of the oscillator D, and it represents the bracket of the crankpin bearing liner 24, which can take both the radial and the axial forces.

The oscillator D is the subassembly of the engine which is subject to the greatest mechanical stresses, due to the fact that it transforms the translation movement of the pistons 2 into the rotation movement of the primary shaft A, by means of a crankpin bearing m made up of the crankpin bearing liner 24 and the cylindrical part of the section 5 of the primary shaft A and by means of a spherical bearing formed by the spherical end l and the spherical bearing liner 22.

In order to prevent the oscillator D from rotating together with the primary shaft A, in the lower part of the crankcase 29 there is a guiding system E, made up of a fork 26, mounted so as to rotate within the body of the oscillator D, which slides together with the oscillator on a guiding rail 27, which bears on two radial bearings 28 which let it rotate. The guiding system E gives freedom of movement to the oscillator and allows the take over of the possible pendulary displacements of the oscillator.

According to the invention, the two-stroke axial engine has a similar ignition, lubrication and cooling system to those already known and therefore they are not detailed.

According to the present invention, the two-stroke axial engine has the following advantages:

it ensures small sizes and a low specific weight it allows a lower specific fuel consumption per kg, HP and hour it ensures a high thermal efficiency and reduces the noxious components from the exhaust gases.

I claim:

1. A two-stroke axial engine comprising:

an engine block having a central axis;

a drive shaft rotatably mounted in said engine block on said central axis, said shaft having ends thereof extending from opposite faces of said engine block, each end of said shaft being provided with a respective oscillator articulated thereto;

a plurality of throughgoing cylinders formed in said engine block in a circular array centered on said axis and lying parallel thereto;

a respective pair of opposed pistons provided in each of said cylinders, each respective pair of pistons forming between them a respective combustion chamber;

a respective connecting rod articulated between each piston of said respective pairs of pistons and the respective oscillator associated therewith;

a respective separator provided at an intersection of each cylinder with a face of said engine block, each respective separator forming with the respective piston of the associated cylinder a respective scavenging chamber, each respective connecting rod traversing a respective separator in a gastight manner;

a respective passageway communicating between each scavenging chamber and the respective combustion chamber associated therewith whereby a gas mixture contained in said scavenging chamber is driven into said combustion chamber upon retraction of the respective piston associated therewith into said scavenging chamber;

a respective inlet aperture formed in each of said scavenging chambers for admission of said gas mixture thereto;

means on said drive shaft for controlling a supply of said gas mixture to said apertures; and a respective guiderail provided at each face of said engine block, each guiderail being slideably engaged by a respective oscillator, said inlet apertures opening on said drive shaft and respective pairs of said apertures associated with the same cylinder lie in longitudinal alignment along said shaft, said means on said shaft for controlling the supply of said gas mixture includes at least one longitudinal groove formed in said shaft and extending between respective pairs of apertures upon rotation of said shaft, each of said separators being formed by a spherical case mounted on said engine block, a first spherical bushing mounted in said case, a cylindrical sleeve mounted in said first bushing, a second spherical bushing mounted in said sleeve between said sleeve and the respective connecting rod associated therewith, the connecting rod slideably traversing said second bushing, and a first ring-shaped gasket provided between said case and said first bushing, and a second ring-shaped gasket provided between said sleeve and said second bushing, whereby said rod is free to describe arcuate movements, and said oscillator engaging said guiderail by a fork limitedly rotatable with said oscillator transverse to said central axis, and said guiderail is pivotally mounted on said engine block parallel to said central axis.

* * * * *